United States Patent [19]

Sumida et al.

[11] Patent Number: 4,517,169

[45] Date of Patent: May 14, 1985

[54] METHOD OF PRODUCING CARBON FIBERS

[75] Inventors: Atsushi Sumida, Ehime; Keiichiro Ozaki, Iyo; Shizuo Watanabe, Ehime, all of Japan

[73] Assignee: Toray Industries, Inc., Tokyo, Japan

[21] Appl. No.: 500,434

[22] Filed: Jun. 2, 1983

[30] Foreign Application Priority Data

Jun. 2, 1982 [JP] Japan ..... 57-92971

[51] Int. Cl.[3] ..... D01F 9/14

[52] U.S. Cl. ..... 423/447.4; 8/115.5; 423/447.6

[58] Field of Search ..... 423/447.1, 447.2, 447.4, 423/447.6; 264/29.2; 8/115.5

[56] References Cited

U.S. PATENT DOCUMENTS 3,285,696 11/1966 Tsunoda ..... 423/447.6
3,533,743 10/1970 Prescott et al. ..... 423/447.6
3,539,295 11/1970 Ram ..... 423/447.6

FOREIGN PATENT DOCUMENTS 57-25417 2/1982 Japan ..... 423/447.6
1300239 12/1972 United Kingdom .

*Primary Examiner*—Edward J. Meros
*Attorney, Agent, or Firm*—Birch, Stewart, Kolasch & Birch

[57] ABSTRACT

A method of producing carbon fibers in which an exhaust gas generated in a heat-treating stage of the production of carbon fibers is divided into two portions, one portion thereof being decomposed by the action of an oxidizing catalyst and subsequently being blended with the other portion, to be reused. According to said method, the heat loss in the exhaust gas disposal process can be substantially reduced and the efficiency of heat-treating can be improved and in consequence, various troubles due to the decomposed products contained in the heat-treating atmosphere such as surface damage, fuzziness and individual fiber breakage, etc. can be avoided.

17 Claims, 5 Drawing Figures

METHOD OF PRODUCING CARBON FIBERS

BACKGROUND OF THE INVENTION

1. Field of the Invention

The present invention relates to a method of producing carbon fibers which mean both oxidized fibers and carbonized fibers in this specification and claims, and more specifically to an efficient treatment process of the oxidizing atmosphere discharged from the heat-treating device for producing carbon fibers.

2. Description of the Prior Art

Carbon fibers are usually produced by heat-treatment of acrylic fibers, pitch fibers or polyvinylalcoholic fibers under conditions of temperature and atmosphere suitable for the respective fibers. We will take acrylic carbon fibers as an example hereunder. First, acrylic fibers are heated and fired at 200°–280° C. in an oxidizing gas (for example in air) to make them so-called "oxidized fibers" and subsequently they are carbonized at 800°–2,800° C. in an inert gas (for example in nitrogen gas), thereby producing carbon fibers.

With respect to such heat treatment process, among others, in the case of the process of heating acrylic fibers in an oxidizing gas at 200°–280° C., decomposed products of precursors or oil adhered to precursors such as HCN, $NH_3$, CO or tar-like substance are released into the atmospheric gas and accumulated to a high concentration. The fibers treated in such an atmosphere are liable to be involved in troubles such as destructions of fiber surface or remarkable deterioration of physical properties of the produced carbon fibers due to voids formed therein.

Well-known countermeasures for these troubles in the conventional heat treatment are: (1) a part of the atmosphere containing said decomposed products (hereinafter referred to as "exhaust gas", which normally accounts for about 20% of the total volume of the atmosphere) is discharged out of the system, while a fresh atmosphere heated to a specified temperature is replenished; or (2) the exhaust gas is totally decomposed by means of an oxidizing catalyst and recycled for use (Japanese Patent Application Laid-open No. SHO 57-25417), but all of these measures have a drawback of suffering a heavy loss of heat.

In the case of above (1) in which the exhaust gas of 200°–280° C. is discharged and replaced with an equivalent volume of the atmosphere which is heated to the same temperature of 200°–280° C., the loss of thermal energy attendant on said discharge and replacement of the atmosphere is naturally heavy. In the case of (2) above in which the decomposed products contained in the exhaust gas are treated by a catalyst in the course of circulation of the exhaust gas and then used again, the loss in thermal energy may be substantially less than in the case of (1) provided the loss is limited to a loss in the circulating channel. According to the publication in the official gazette of said Japanese Patent Application Laid-open No. SHO 57-25417, however, in said catalyst treatment, the exhaust gas has to be heated to 200°–400° C. for the purpose of enhancing the catalyst action. Investigation by the present inventors indicates that for the purpose of (2) being applied to on an industrial scale, the exhaust gas has to be heated to at least 280° C., otherwise the catalytic action would not be satisfactory. Thus in the case of (2), the exhaust gas must be heated to at least 280° C. to enhance the catalytic action and then it must be cooled to a suitable atmospheric temperature after catalyst treatment, thereby making the heat loss substantial, because the total volume of exhaust gas is subjected to catalyst treatment.

SUMMARY OF THE INVENTION

An object of the present invention is to make the exhaust gas disposal in the heat treatment process in the production of carbon fibers efficient with minimum heat loss.

Another object of the present invention is to prevent environmental or atmospheric pollution due to the release of said exhaust gas.

Still another object of the present invention is to offer high-quality carbon fibers free from destruction of fiber surface, void formation, fuzziness or individual fiber breakeage.

These objects of the present invention can be attained by a carbon fiber producing process in which the exhaust gas discharged from the heat-treating device for the production of carbon fibers is decomposed through an oxidizing catalyst and subsequently circulated to said device for reuse, whereby said exhaust gas is divided into two portions, one of which being left untreated for decomposition, the other portion being catalyst-treated for decomposition, and consequently said two portions are blended for recycling.

If need be, it can be designed such that said two divided portions of the exhaust gas are recombined and then directed through a mixer for a more homogeneous blending, thus making the quality of the produced carbon fibers still better.

BRIEF DESCRIPTION OF THE DRAWINGS

The above and other objects, features and advantages of the present invention will become apparent and will be more readily appreciated from the following detailed description of the present preferred exemplary embodiments of the invention made in conjunction with the accompanying drawings, in which.

DETAILED DESCRIPTION OF THE PREFERRED EMBODIMENT

Figure 1:
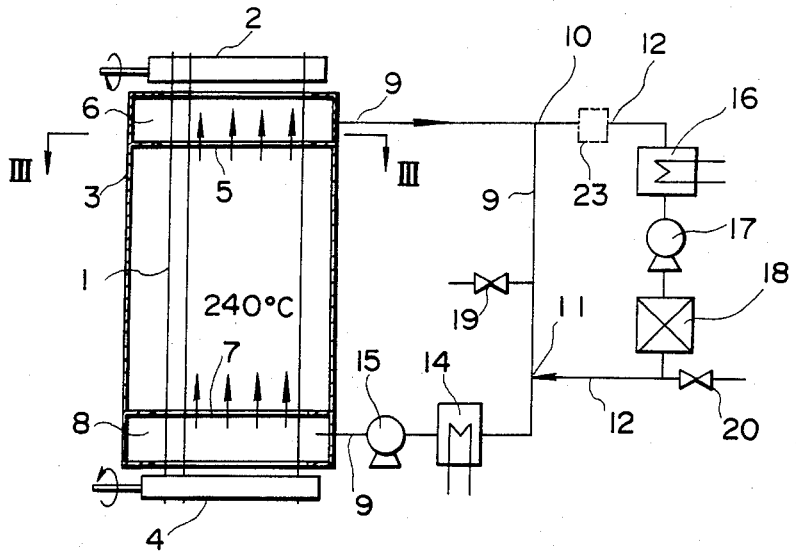
FIG. 1 is a schematic diagram illustrating an example of exhaust gas circulation in an oxidizing stage of the production of carbon fibers according to the present invention.
Figure 2:
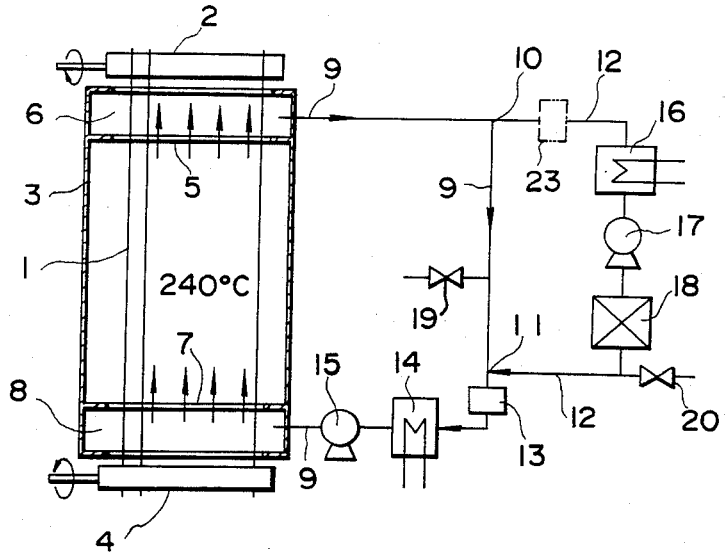
FIG. 2 is a schematic diagram of another example of exhaust gas circulation in which a fluid mixer is installed between the confluence of two gas portions and oxidizing furnace.
Figure 3:
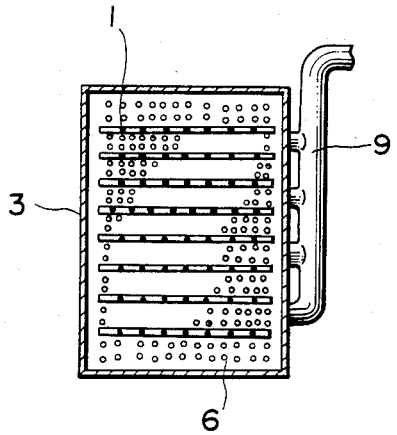
FIG. 3 is a sectional view taken along III—III line in FIG. 1.

An embodiment of the present invention will be described below. FIG. 1 is a schematic diagram of a device used for oxidizing process in the production of carbon fibers. Starting material fibers 1 are introduced into an oxidizing furnace 3 via a rotating upper roller 2 and through an upper slit, and successively taken out of said furnace 3 through a lower slit via a lower roller 4. Depending on the need, starting material fibers 1 are passed undulatingly between a plurality of upper rollers 2 and a plurality of lower rollers 4. At the top of said furnace 3, there is installed a gas discharging chamber 6 having orifices 5 at the bottom, thereof and at the bottom of said furnnace 3, there is installed a gas charging chamber 8 having orifices 7 at the top thereof. The gas discharging chamber 6 and the gas charging chamber 8 are communicated by a gas circulating main duct 9 so that all or a greater part of the gas released from the gas discharge chamber 6 may go into the gas charge chamber 8. There is a branch-off point 10 and a confluence point 11 in the gas circulating main duct 9 and the branch-off point 10 and the confluence point 11 are in communication with a gas circulating sub-duct 12 so that a part of the gas can flow via this duct 12 from the branch-off point 10 to the confluence point 11. In the gas circulating main duct 9, there are arranged in the gas flow direction a fluid mixer 13, a heater 14 and blower 15 in the order mentioned. Presence of said fluid mixer 13 is not mandatory, but preferable for the purpose of producing high-quality carbon fibers through homogeneous blending. FIG. 2 shows the example in which the gas circulating main duct 9 is provided with the fluid mixer 13. In the gas circulating sub-duct 12, there are arranged in the gas flow direction a heater 16, a blower 17 and a gas decomposer 18 holding a catalyst in the order mentioned.

In the oxidizing furnace 3, the oxidization of starting material fibers 1 take place. When the starting material fibers 1 are acrylic fibers, the temperature of the heating atmosphere is set normally in the range of 200°–280° C., and normally the air is employed as the heating atmosphere. The gas which has contributed to the oxidization of starting material fibers 1 in said furnace 3 is discharged out of the gas discharge chamber 6 into the main circulating duct 9. The gas thus discharged contains the decomposed products generated in the oxidation of starting material fibers 1.

The discharged gas is divided into two portions at the branch-off point 10. One portion (portion-A) continuously flows through the main circulating duct 9 and goes to the furnace 3, while the other portion (portion-B) is diverted into the gas circulating subduct 12 and joins portion-A at the confluence point 11 and finally goes also to the furnace 3. B/A, i.e., the ratio of the flow of portion-B to that of portion-A is usually set in the range of $\frac{1}{2}$–1/10, preferably in the range of $\frac{1}{3}$–1/6. The value of B/A is selected appropriately considering the concentration of decomposed products in the exhaust gas, the temperature of the gas circulated to said furnace 3 and so on.

Portion B is heated in the heater 16 to over 280° C., usually about 300° C., and if necessary sent via blower 17 to the decomposer 18, where the exhaust gas is decomposed and purified through treatment with the oxidizing catalyst.

The most important thing here is to keep the temperature of the catalyst layer in the range of 280°–400° C. If the temperature of the catalyst layer is lower than 280° C., the catalyst activity to oxidize and decompose will drop, causing a tar-like substance of the decomposed products of oil to accumulate in the catalyst layer, which in turn causes a further deterioration of the catalyst activity.

The catalyst effect, however, will not be improved even if the catalyst temperature is raised to over 400° C. and it will merely lead to a loss in the thermal energy. Maintenance of an appropriate temperature of the catalyst layer may be realized by provision of a heater in the catalyst layer or by preheating of the supplied gas, as mentioned above, by the heater 16. For continuous operation on an industrial scale, the latter method will be favorable from a standpoint of thermal energy. Catalysts available for the purpose include chromium, iron, manganese, platinum, copper, palladium and combinations thereof. When a carrier is employed, the catalyst should be $MnO_2$, CuO, $Cr_2O_3$, $Fe_2O_3$, Pt or Pd and it should be used in 0.01–90% by weight of the carrier. The catalyst content in the carrier is somewhat variable with the kind of catalyst, and for instance, $Cr_2O_3$, $MnO_2$, $Fe_2O_3$ or CuO should be contained in 5–80% by weight of the carrier, while Pt or Pd should be contained in 0.1–2% by weight of the carrier.

The catalyst form may be a cylinder, a sphere, an extrusion mold, a honeycomb, a sheet, a ribbon or a hollow tube and the particle diameter of the catalyst may be appropriately selected in the range of 1–20 mm.

A purified gas, i.e., the exhaust gas from which the decomposed products are removed flows on in the gas circulating sub-duct 12 and joins the portion of the exhaust gas not treated (portion-A) at the confluence point 11 and if necessary, it goes to the oxidizing furnace 3 via the heater 14.

The heater 14 serves to adjust the supplied gas to a specific atmospheric temperature in said furnace 3. Therefore, if the value of B/A is about 1:3, service of said heater 14 will be practically needless.

If required, a gas introduction inlet (for instance, for fresh air) 19 or a gas withdrawal outlet 20 may be provided midway in the flow paths off the exhaust gas and the treated gas so that the treated gas can be partially replaced with fresh air to keep the oxygen concentration within said furnace 1 at a specific value.

In the presence of the fluid mixer 13, the gas which has converged at the confluence point 11 will continue to be blended to homogeneity in the fluid mixer 13 and with any extreme temperature variance corrected in a transverse direction of the flow, it will, if necessary, be put through the heater 14 to be heated to the necessary temperature and, being driven by the blower 15, it will be circulated to said furnace 3 via the gas circulating main duct 9 and the gas charge chamber 8.

Figure 4:
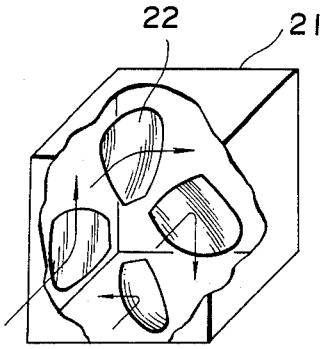
FIG. 4 is a fragmentary perspective view of the fluid mixer shown in FIG. 2.
Figure 5:
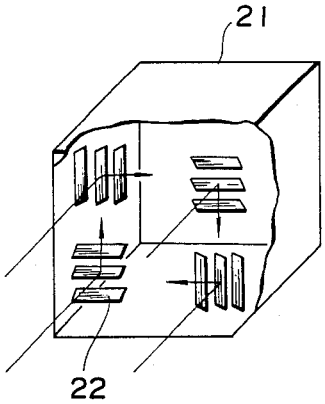
FIG. 5 is a fragmentary perspective view of a different type of fluid mixer from FIG. 4.

From the standpoint of energy saving, which is one of the objects pursued by the present invention, a static mixer as shown in FIGS. 4 and 5, which consists of a casing 21 which holds a plurality of colliding blades 22 fixed or adjustable in position, will be preferable as the fluid mixer 13 to any mechanical agitator having a positive agitation drive element.

As described above, according to the present invention, in which the exhaust gas generated in the heat-treating stage of the production of carbon fibers is divided into two portions, one portion thereof being decomposed by the action of an oxidizing catalyst and subsequently being blended with the other portion, to be reused, the heat loss in the exhaust gas disposal process can be substantially reduced, and since only one portion of the exhaust gas is submitted to decomposing treatment with an oxidizing catalyst, the treating efficiency is remarkably high with the result that the gas supplied to a heat-treating chamber can be purified and in consequence various troubles due to the decomposed products contained in the atmosphere of the heat-treating chamber such as surface damage to treated fibers, fuzziness, individual fiber breakeage, etc. can be avoided to the utmost extent. Moreover, for the sake of balancing the exhaust gas volume, the purified gas after treated with the oxidizing catalyst may, if necessary, be released without pollution of the environment or the air.

Meanwhile, homogeneous blending in the mixer of rejoined portion of the gas in the process of oxidizing the fibers will yield an effect of minimizing the variance in the oxidized degree between individual fibers. For instance, the upper limit of the atmospheric temperature difference between the left extreme fiber 1 and the right etreme fiber 1 in the oxidizing furnace of FIG. 1 is set at 2° C. When the gas is put through the fluid mixer 13, this temperature difference limit can be satisfied, contributing to an increase in the size of the oxidizing furnace and in the volume of circulated gas.

Several examples of embodying the present invention are given hereunder.

EXAMPLE 1

In the flow illustrated by FIG. 1, acrylic precursors were continuously supplied at a rate of 1 kg/hr to the oxidizing furnace 3 of 250° C. hot-gas circulation system and were oxidized. Circulation of the 250° C. hot-gas in said furnace 3 was set at 1,000 $Nm^3$/hr. ¼ portion (250 $Nm^3$/hr) of the exhaust gas (1,000 $Nm^3$/hr) from said furnace 3 was directed into the gas circulating sub-duct 12 by adjusting the open degree of the damper 23 and said portion was heated to 300° C. by the heater 16 and submitted to the specified catalyst treatment in the gas decomposer 18. Thus heated, the hot gas (purified) converges at the confluence point 11 with the other portion of the exhaust gas flowing through the gas circulating main duct 9. And via the heater 14 in which the gas was heated to 250° C., it was supplied to said furnace 3. On the other hand, for the purpose of comparison a valve was provisionally installed at the inlet to said duct 9 and the total volume of the exhaust gas (1,000 $Nm^3$/hr) was heated to 300° C. in the heater 16 for the specified catalytic treatment.

In this example the decomposed hot-gas (purified) was exchanged for the atmosphere through the gas introduction inlet 19 and the gas withdrawal outlet 20 for the purpose of temperature adjustment.

One month of continuous operation was made and the power consumption thereby is compared in Table 1, which testifies that the present invention is effective for substantial saving.

TABLE 1

| | Amount of gas circulated ($Nm^3$/hr) | Catalytic treatment Gas volume ($Nm^3$/hr) | Catalytic treatment Gas temperature (°C.) | Power consumed (Kw) |
|---|---|---|---|---|
| Present invention | 1,000 | 250 | 300 | 10 |
| Comparative example | 1,000 | 1,000 | 300 | 30 |

EXAMPLE 2

The volume and temperature of the exhaust gas flowing in the gas circulating sub-duct 12 in Example 1 were arbitrarily changed and the decomposition was made under the following conditions.

Catalyst: Pt carried at a rate of 2 g/1 on $Al_2O_3$ carrier of particle diameter 2 mm Catalyst volume: 50 liters, The results are summarized in Table 2, which shows that the catalyst action is satisfactory in the temperature range of 280° C.–400° C.

TABLE 2

| Test No. | Exhaust gas volume ($Nm^3$/hr) | Exhaust gas temperature (°C.) | Tar concentration in treated gas (mg/$Nm^3$) |
|---|---|---|---|
| 1 | 250 | 250 | 900 |
| 2 | 250 | 280 | 100 |
| 3 | 250 | 300 | 50 |
| 4 | 250 | 350 | 50 |
| 5 | 250 | 400 | 50 |
| 6 | 500 | 250 | 800 |
| 7 | 500 | 280 | 80 |
| 8 | 500 | 300 | 40 |
| 9 | 500 | 350 | 40 |
| 10 | 500 | 400 | 40 |
| 11 | 1,000 | 250 | 600 |
| 12 | 1,000 | 280 | 60 |
| 13 | 1,000 | 300 | 30 |
| 14 | 1,000 | 350 | 30 |
| 15 | 1,000 | 400 | 30 |

EXAMPLE 3

The oxidized fibers of Example 1 were carbonized for 2 minutes under a nitrogen atmosphere in a carbonizing furnace operating at 1,250° C. maximum. The properties of thus produced carbonized fibers are summarized in Table 3, which shows that there is no substantial difference between the carbonized fibers by the present invention and the carbonized fibers by the comparative example.

TABLE 3

| | Strength (Kg/$mm^2$) | Elasticity (t/$mm^2$) | Fuzziness pieces ( /m) | Individual Fiber breakage (count/week) |
|---|---|---|---|---|
| Present invention | 380 | 23.4 | 10 | 0 |
| Comparative example | 370 | 23.6 | 9 | 0 |

Although only preferred embodiment of the present invention has been described in detail, it will be appreciated by those skilled in the art that various modifications and alterations can been made to the particular embodiments shown without materially departing from the novel teachings and advantages of this invention. Accordingly, it is to be understood that all such modifications and alterations are included within the scope of the invention as defined by the following claims.

What is claimed is:

1. In a method for producing carbonizable oxidized fibers comprising:

introducing the fibers to be oxidized into a heat-treating device; and oxidizing the fibers in said heat-treating device with an appropriate oxidizing gas at a temperature sufficient to effect oxidation; the improvement comprising withdrawing the spent oxidizing gas from said heat-treating device as an exhaust gas;

dividing said exhaust gas into a first and second portion;

returning the first portion, untreated, to said heat-treating device;

treating the second portion by passing it over an oxidation catalyst system at a temperature of 280°–400° C. to purify said second portion; and returning the purified second portion of said gas to said heat-treating device for reuse.

2. The method according to claim 1, wherein the ratio B/A of the two portions is ½–1/10, the numerator B being that portion of the exhaust gas to be treated by the oxidation catalyst system and the denominator A being that untreated portion of the exhaust gas which is returned for reuse in the heating treating device.

3. A method according to claim 2, wherein the ratio B/A of said two portions is ⅓–1/6.

4. The method according to claim 1, wherein the treated portion is combined with the untreated portion before being introduced into the heat-treating device.

5. The method according to claim 4, wherein the treated and untreated portions of the exhaust gas are combined in a fluid mixer.

6. The method according to claim 5, wherein the combining of the treated and untreated portions of the exhaust gas is accomplished in a fluid mixer containing a plurality of static colliding blades.

7. The method according to claim 1, wherein the unoxidized fibers are continuously introduced into the heat-treating device and the oxidized fibers are continuously removed from the heat-treating device.

8. The method according to claim 1, wherein the spent oxidizing gas is continuously removed from the heat-treating device.

9. The method according to claim 1, wherein the oxidation of the fibers in the heat-treating device is conducted at a temperature of 200°–280° C.

10. The method according to claim 1, wherein the catalyst is selected from the group consisting of chromium, iron, manganese, platinum, copper, palladium, and any mixture thereof.

11. The method according to claim 10, wherein the exhaust gas discharged from the heat-treating device is the gas generated in the process of heating and oxidizing the fibers at 200° C.–280° C. in the oxidizing gas atmosphere.

12. The method according to claim 5, wherein the catalyst has a diameter of 1–20 mm.

13. The method according to claim 1, wherein the fibers are acrylic fibers.

14. In a method of producing carbonizable oxidized fibers, comprising:

(a) continuously introducing fibers into an oxidizing heat-treating device;

(b) continuously introducing an oxidizing gas into the oxidizing heat-treating device through a first duct and oxidizing said fibers at a temperature of 200°–280° C.; and (c) continuously removing the oxidized fibers from the heat-treating devices; the improvement comprising (d) continuously removing the spent oxidizing gas from the heat-treating device through a second duct as an exhaust gas;

(e) continuously separating 1/10 to ½ of said exhaust gas flowing in the second duct through a fourth duct;

(f) continuously recycling the remaining exhaust gas from the first duct through a third duct, one end of said third duct being connected to the second duct and the other end thereof being connected to the first duct;

(g) heating the exhaust gas in said fourth duct to a temperature of 280° to 400° C.;

(h) decomposing and purifying the exhaust gas by contacting it with an oxidation catalyst provided in the fourth duct;

(i) returning the purified exhaust gas flowing in the fourth duct to the confluence point of the first, third, and fourth ducts, to form a mixture of untreated and treated gases;

(j) adjusting the temperature of said gas mixture within the range of 200° C. to 280° C.; and (k) continuously returning said mixture to the oxidizing heat-treating device.

15. The method of producing carbinizable oxidized fibers of claim 14, wherein the catalyst is selected from the group consisting of $MnO_2$, CuO, $Cr_2O_3$, $Fe_2O_3$, Pt, Pd and combinations thereof.

16. In a method of producing carbonizable oxidized fibers, comprising:

(a) continuously introducing fibers into an oxidizing heat-treating device;

(b) continuously introducing air into the oxidizing heat-treating device through a first duct, and oxidizing said fibers at a temperature of 200°–280° C.; and (c) continuously removing the oxidized fibers from said heat-treating device; the improvement comprising (d) continuously removing the spent air from said heat-treating device through a second duct as an exhaust gas;

(e) continuously separating 1/6 to ⅓ of said exhaust gas flowing in the second duct through a fourth duct;

(f) continuously recycling the remaining exhaust gas from the first duct through a third duct, one end of said third duct being connected to the second duct and the other end thereof being connected to the first duct;

(g) heating the exhaust gas in said fourth duct to a temperature of 280° to 400° C.;

(h) decomposing and purifying the exhaust gas by contacting it with a catalyst provided in the fourth duct, said catalyst being selected from the group consisting of $MnO_2$, CuO, $Cr_2O_3$, $Fe_2O_3$, Pt, Pd, and combinations thereof;

(i) returning the purified exhaust gas flowing in the fourth duct to the confluence point of the first, third, and fourth ducts to form a mixture of untreated and treated gases;

(j) positively blending said gas mixture at the confluence point in a fluid mixer having a plurality of static colliding blades (k) adjusting the temperature of said air mixture within the range of 200° C. to 280° C.; and (l) continuously returning the gas mixture to the oxidizing heat-treating device.

17. In a method for producing carbon fibers comprising:

introducing fibers to be oxidized into a heat-treating device;

oxidizing the fibers in said heat-treating device with an appropriate oxidizing gas at a temperature sufficient to effect oxidation to produce oxidized fibers and carbonizing the oxidized fibers in a carbonizing furnace; the improvement comprising withdrawing the spent oxidizing gas from said heat-treating device as an exhaust gas;

dividing said exhaust gas into a first and second portion;

returning the first portion, untreated, to said heat-treating device;

treating the second portion by passing it over an oxidation catalyst system at a temperature of 280°–400° C. to purify said second portion; and returning the purified second portion of said gas to said heat-treating device for resue.

* * * * *